US006179049B1

(12) United States Patent
Higgins

(10) Patent No.: US 6,179,049 B1
(45) Date of Patent: Jan. 30, 2001

(54) HEAT EXCHANGER WITH AN INTEGRATED TANK AND HEAD SHEET

(75) Inventor: Kenneth Terry Higgins, Metamore, MI (US)

(73) Assignee: Lattimore & Tessmer, Inc., Southfield, MI (US)

( * ) Notice: Under 35 U.S.C. 154(b), the term of this patent shall be extended for 0 days.

(21) Appl. No.: 09/305,759

(22) Filed: May 5, 1999

Related U.S. Application Data

(63) Continuation-in-part of application No. 09/080,475, filed on May 18, 1998.

(51) Int. Cl.[7] ..... F28D 7/10

(52) U.S. Cl. ..... 165/140; 165/176; 165/148; 29/890.052

(58) Field of Search ..... 165/140, 148, 165/153, 176; 184/104.3; 123/41.1, 196 AB; 29/890.052

(56) References Cited

U.S. PATENT DOCUMENTS

| | | | | |
|---|---|---|---|---|
| 4,749,033 | * | 6/1988 | Clausen | 165/176 |
| 4,896,718 | | 1/1990 | Trin . | |
| 4,903,760 | | 2/1990 | Joshi et al. . | |
| 4,923,001 | | 5/1990 | Marcolin . | |
| 5,067,561 | | 11/1991 | Joshi et al. . | |
| 5,737,952 | * | 4/1998 | Baumann et al. | 29/890.052 |
| 5,829,133 | * | 11/1998 | Joshi et al. | 29/890.052 |
| 5,898,996 | * | 5/1999 | Buchanan et al. | 29/890.052 |
| 5,934,366 | * | 8/1999 | Gowan | 165/174 |
| 5,941,303 | * | 8/1998 | Gowan at al. | 165/176 |
| 6,095,239 | * | 8/2000 | Makino et al. | 165/140 |

* cited by examiner

*Primary Examiner*—Ira S. Lazarus
*Assistant Examiner*—Terrell McKinnon
(74) *Attorney, Agent, or Firm*—Harness, Dickey & Pierce, P.L.C.

(57) ABSTRACT

A heat exchanger having a core of a plurality of cooling tubes with a tank at each end of the core tubes. The tanks are formed with a plurality of cooling tube receiving apertures along a side portion of the tanks. These apertures receive the ends of the cooling tubes directly into the tanks and are attached to the tubes by brazing. Since the cooling tubes are received in apertures formed in the tanks themselves, the need for a separate head sheet at the end of the core is eliminated thereby eliminating the need for sealing of a head sheet to a separate tank. The tanks are preferably formed in a hydroforming operation to shape the tanks from a tubular blank.

21 Claims, 4 Drawing Sheets

HEAT EXCHANGER WITH AN INTEGRATED TANK AND HEAD SHEET

CROSS REFERENCE TO RELATED APPLICATION

This application is a Continuation-in-Part of U.S. patent application Ser. No. 9/080,475, filed May 18, 1998.

BACKGROUND AND SUMMARY OF THE INVENTION

The present invention relates to heat exchangers having a core of cooling tubes with a tank at each end of the core and in particular to a heat exchanger in which the core tubes are directly joined to the tank without an intermediate head sheet.

Typical liquid to air heat exchangers, such as automotive radiators, include a core assembly of a plurality of cooling tubes with fins. The cooling tubes extend between spaced head sheets or header plates. The end of the tubes extend through apertures in the head sheets and are sealed thereto, typically by brazing. A tank formed as a three dimensional stamped metal body or a molded plastic body having an open side, is joined to each of the head sheets and sealed thereto to form a closed tank at each end of the core. Fluid flows from one tank through the cooling tubes to the other tank. A second fluid, typically air, passes between the fins to remove heat from the cooling tubes and thereby cool the fluid in the tubes as it flows from one tank to the other.

The seal between each tank and the head sheet is difficult to properly from and can be the source of leaks during the use of the heat exchanger. Accordingly, it is an object of the invention to provide an improved heat exchanger construction that overcomes the problems associated with the sealing of the core head sheet to the tank.

The present invention overcomes the problems in the prior art by forming the tank and head sheet as an integral, single piece body. A closed tank is formed with apertures along one side for receiving the cooling tubes. The tubes are then inserted directly into the tank. This eliminates the need for a separate head sheet and the need to seal the separate head sheet to the tank. The tubes are sealed to the tank by brazing, in a conventional manner, for constructing a heat exchanger.

The heat exchanger tanks are shaped by a hydroforming process in which an elongated tubular blank is first placed in a die cavity that matches the tank s desired shape. The interior of the tubular blank is sealed and then highly pressurized with a fluid, such as water or oil, so that its outer surface is forced to take the shape of the cavity.

The hydroforming cavity includes inwardly projecting chisel points or punches. After the tube assumes the cavity shape the punches are actuated and pierce the tank.

During hydroforming, outwardly projecting ribs are formed between each of the cooling tube receiving apertures to stiffen the tank. These ribs extend in a circumferential direction relative to the tube longitudinal axis. Cylindrical projections from the tube are also formed during hydroforming. These projections form inlet and outlet necks for the tanks. During hydroforming, the cylindrical projections have closed ends. These ends are later removed, forming the open cylindrically shaped necks.

The open end or ends of the tube blank are closed with an end cap after the tank is hydroformed. The end caps are sealed to the tank by brazing.

An auxiliary oil cooler can be disposed in one of the tanks. The inlet and outlet tubes of the auxiliary cooler extend through one of the tank end caps. The end cap at the opposite end of the tank can be shaped to form a support ledge for supporting the end of the auxiliary cooler. The fluid in the oil cooler is cooled by the first fluid which is typically water or a mixture of anti-freeze and water. Alternatively, the auxiliary oil cooler can be attached to one of the tanks and the other of the tanks to provide structural support thereto and to permit the auxiliary oil cooler to be cooled by a second fluid, such as air.

During hydroforming, outwardly or inwardly extending protrusions can also be formed on the tank to locate the heat exchanger on a rubber mount when attaching the heat exchanger to a supporting structure. The protrusion is typically disposed into a groove in the rubber mount. The rubber mount isolates the heat exchanger from vibration of the support structure, such as an automobile.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
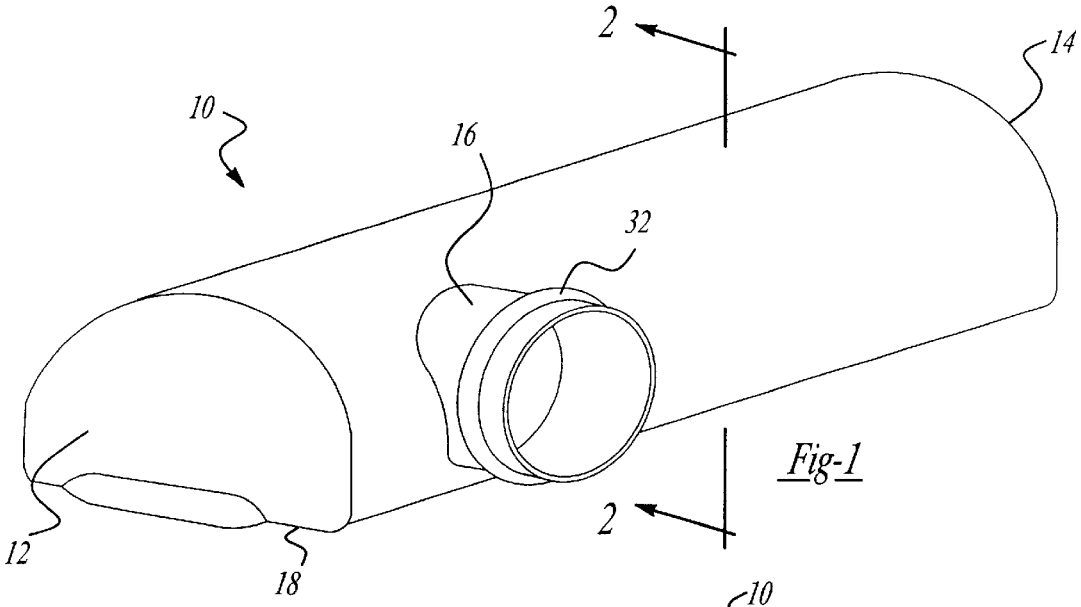
FIG. 1 is a prospective view of a radiator tank constructed according to the present invention.
Figure 2:
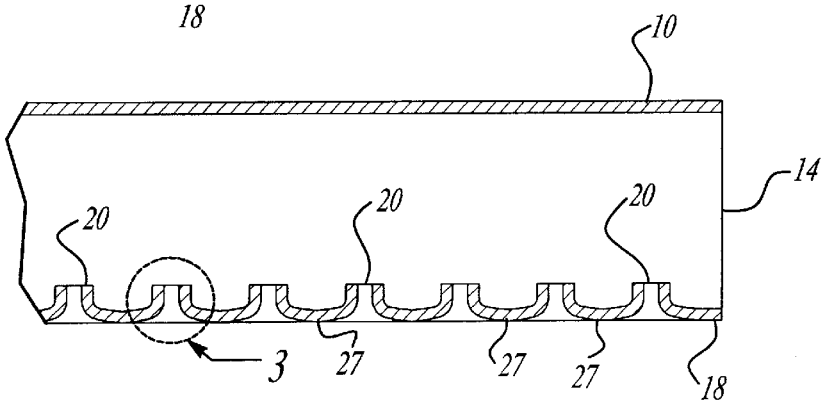
FIG. 2 is a sectional view of the heat exchanger tank as seen from substantially the line 2—2 in FIG. 1.

In reference to FIG. 1, a heat exchanger tank 10 is shown which is made according to the present invention. The tank 10 has a generally tubular body and is shaped by a hydroforming operation. A tubular blank is placed between a pair of dies that close over the tube to create a sealed cavity. The surface of the die cavity matches the desired final shape of the tank 10. The interior of the tubular blank is sealed and highly pressurized with a fluid, such as water or oil, so that its outer surface is forced to take the shape of the cavity. The tank 10 has ends 12 and 14. both of the ends are open. The hydroforming liquid is introduced into the tubular blank through the open ends. During the hydroforming process, an inlet/outlet 16 is formed which projects or extends from the side of the tank. The tank side portion 18 is generally flat in the preferred embodiment.

Figure 3:
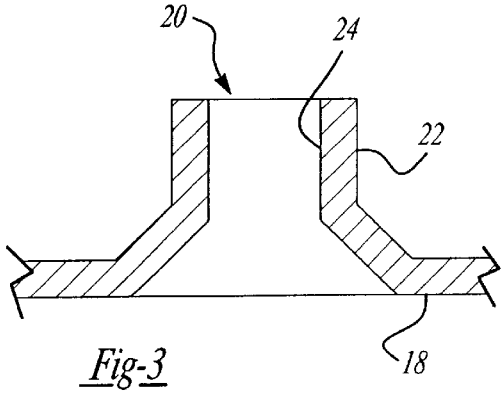
FIG. 3 is an enlarged sectional view of the circled portion of FIG. 2.
Figure 4:
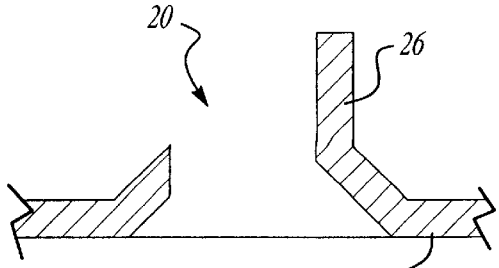
FIG. 4 is an enlarged sectional view of an alternative embodiment of the circled portion in FIG.2

A plurality of chisel points are mounted into the die cavity tool. After the hydroforming operation, the chisel points pierce the tank forming, a plurality of cooling tube apertures 20 in the tank side portion 18. The apertures 20 can be made of any suitable shape including round, oval or any of the variety of shapes used to form holes in heat exchangers or which could be used in heat exchangers. Such apertures 20 may be formed by the use of round, oval chisel point or dog-boned chisel point punches. Additionally, the apertures 20 may also be formed with a punch which includes a ferrule form and lead-in to assist in the assembly of tubular core members into the head tank. With reference to FIG. 3, a cooling tube aperture 20 is shown in greater detail. As a result of the chisel point pierce operation, the aperture is surrounded by an upstanding ferrule 22. The upstanding ferrule 22 provides a relatively large surface area 24 for contact with a cooling tube that is subsequently inserted into the hole 20. An alternative embodiment of the ferrule is shown in FIG. 4. There a 3-sided punch is used which forms an upstanding slug 26 to one side of the aperture 20.

Between adjacent tube apertures 20, an outward projecting rib 27 is formed. The ribs extend in a circumferential direction transverse to the tube length to stiffen the tank, and provide a tube lead in for assembly.

Figure 5:
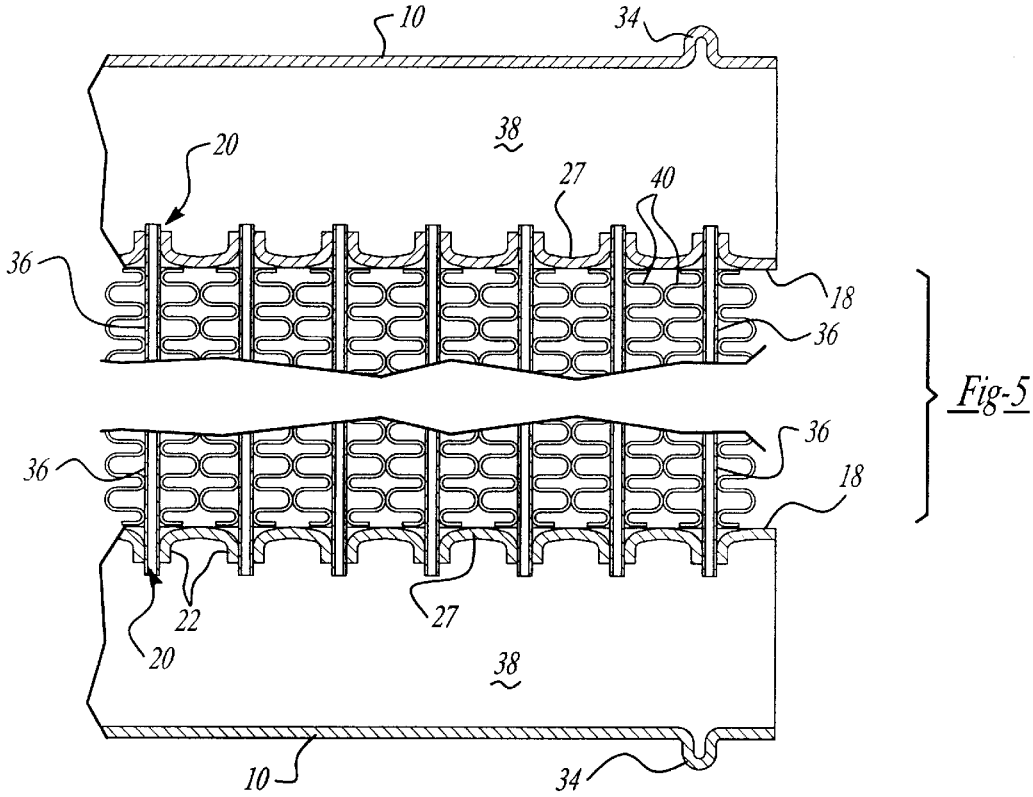
FIG. 5 is a sectional view of a heat exchanger having two tanks and cooling tubes therebetween.
Figure 6:
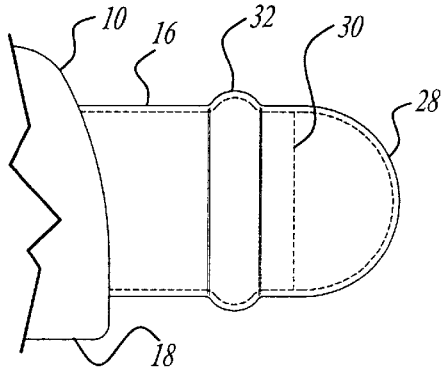
FIG. 6 is a side elevational view of an inlet/outlet to the radiator tank.

With reference to FIG. 6, an inletfoutlet 16 is formed during the hydroforming process. The inlet/outlet neck 16 has a closed end portion 28 which may be formed hemispherically as shown in FIG. 6. The closed end portion 28 is removed by cutting the inlet/outlet along the line 30, thereby creating an open end on the inlet/outlet. A raised rib 32 around the neck assists in retaining a hose on the neck. Identically shaped tanks can be used on both ends of the core. On one tank, the neck 16 will be the heat exchanger inlet. On the other tank, it will be the heat exchanger outlet. Both tanks can be made with the same hydroform die. An assembled heat exchanger is shown in greater detail in FIG. 5. A pair of identical tanks 10 are shown spaced from one another. The tanks are oriented with their two flats side positions 18, with the cooling tube apertures, facing each other. The ends of a plurality of cooling tubes 36 are inserted into the cooling tube apertures 20 of each tank. The tubes 36 are typically surrounded by a plurality of flat or corrugated fins 40 to assist in heat transfer from the tubes. The tubes are subsequently brazed to the tanks 10 in a furnace brazing operation in a conventional manner for manufacturing heat exchangers. This provides a sealed connection between the cooling tubes 36 and the tanks 10. The tubes can be at any cross sectional shape but are preferably flat tubes. The tube apertures 20 are correspondingly slot shaped. The slots are oriented parallel to the ribs 27, in a circumferential direction, relative to the tank.

The tanks can be hydroformed with protrusions 34 to locate the tank on a rubber mount, etc., when mounting the heat exchanger on a support structure, such as an automobile body.

The tanks and tubes can be made of aluminum, brass, steel, stainless steel or any of a variety of metals used in heat exchangers or which could be used in heat exchangers.

Figure 7:
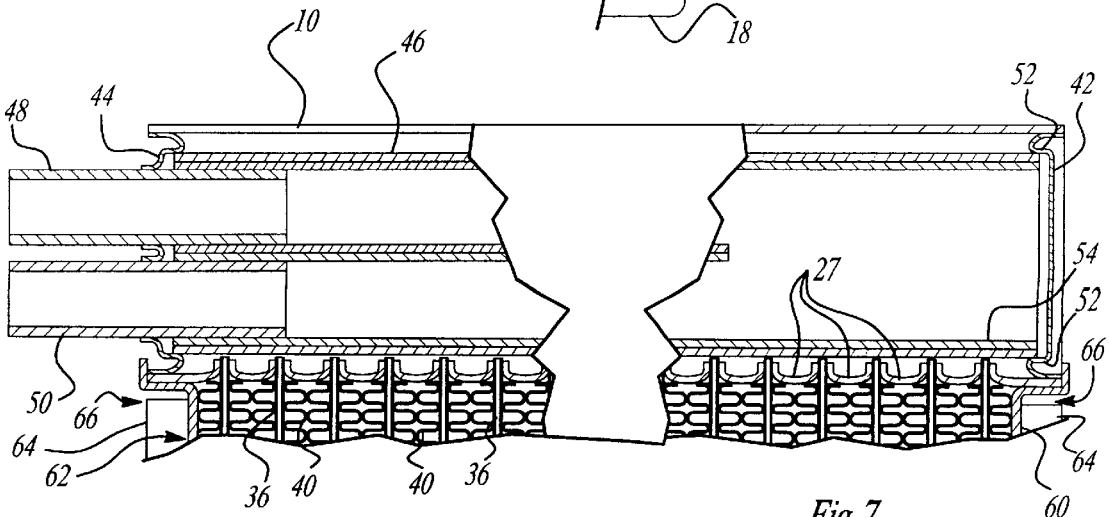
FIG. 7 is sectional view of a tank having an auxiliary oil cooler therein.

With reference to FIG. 7, a tank 10 is shown sealed at the ends by a pair of end caps 42 and 44. The end caps are stamped to shape and are also clad so that they can be brazed to the tank ends. In the embodiment shown in FIG. 7, the tank houses a secondary or auxiliary oil cooler 46 used to cool engine oil or transmission oil in an automotive radiator. The auxiliary cooler has an inlet pipe 48 and an outlet pipe 50 extending through the end cap 44. The end cap 42 is stamped in a shape to form a support ledge 52 to support the distal end 54 of the auxiliary cooler. The end caps are mechanically joined to the tank by toggle locks or other metal crimping operations to hold the end caps in place during assembly and prior to the brazing process.

The heat exchanger may also include a pair of side supports 60 and 62 shown in FIG. 7 . These side supports extend between the two tanks 10 and hold the tanks in place relative to one another. These side supports include an outward extending flange 64 to stiffen the side supports. However, at the ends of each side support, there is a small gap 66 in the flange. This forms a stress relief to allow the heat exchanger to expand and contract during thermal cycling.

Figure 8:
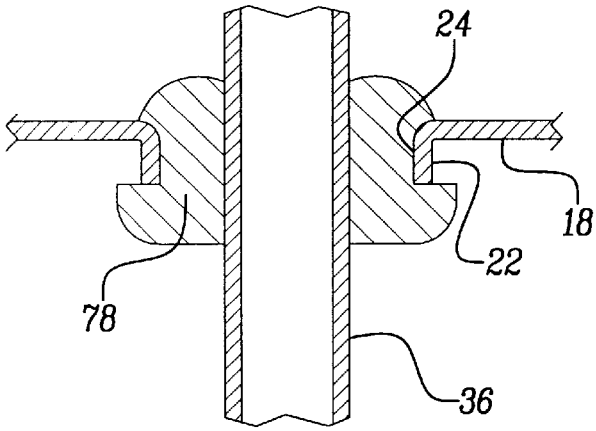
FIG. 8 is an enlarged sectional view of an alternative embodiment of the circled portion in FIG. 2.

Those skilled in the art will recognize that the tube endings 36 need not be brazed to the cooling tube apertures 20 of each tank. Alternatively, an elastomeric grommet or gasket 78 may be inserted between the tube and the apertures, as shown in FIG. 8.

The heat exchanger of the present invention provides an integrated tank and head sheet. The cooling tube apertures are formed directly into the tanks. This avoids the need for a separate head sheet connected to the cooling tubes which must subsequently be sealed to a tank. In a preferred method of manufacture of the heat exchanger, the tanks are hydroformed to the desired shape and the cooling tube receiving apertures are pierced into the tank after the hydroforming operation. The heat exchanger is subsequently assembled by inserting the cooling tubes directly to the tanks and sealing by brazing, or other joining process.

Figure 9:
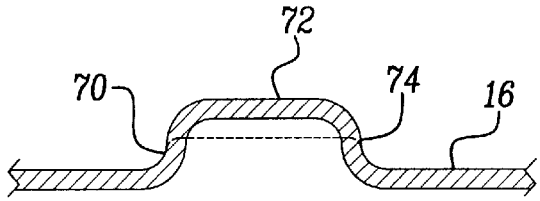
FIG. 9 is a side elevational view of an overflow protrusion to the radiator tank.

Optionally, an overflow protrusion 70 is formed in the inlet 16 of the first tank 10, as shown in FIG. 9. The overflow protrusion 70 has a closed end 72 which is removed by cutting the protrusion along the line 74 thereby creating an open end in the protrusion 70. The overflow protrusion 70 can be threaded, potted with epoxy or filled with an adhesive to connect it by means of a line (not shown) which is connected to an overflow bottle (not shown).

Figure 10:
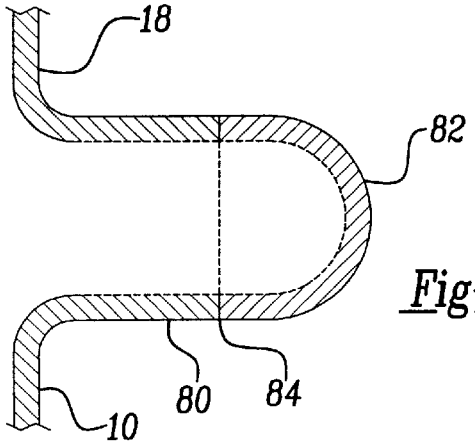
FIG. 10 is a side elevational view of a radiator cap protrusion for the radiator tank.
Figure 11:
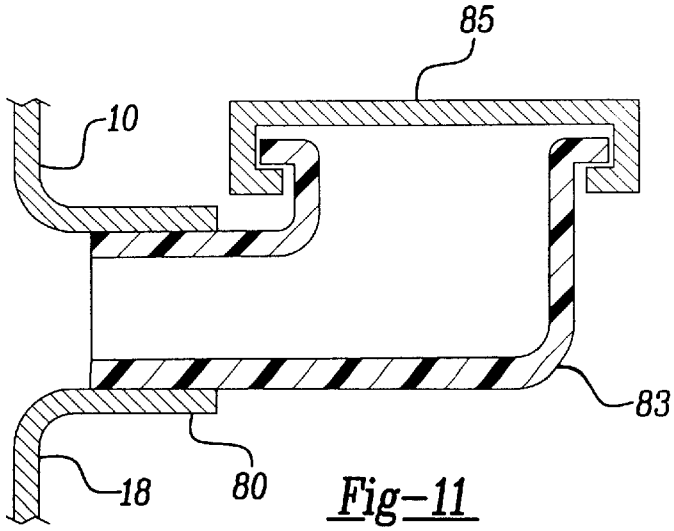
FIG. 11 is a side elevational view of a radiator cap protrusion and radiator fill elbow for the radiator tank.

Additionally, the first tank may be formed with a radiator cap protrusion 80 in the first tank, as shown in FIGS. 10 and 11. The radiator cap protrusion 80 has a closed end 82 and it is cut along line 74 to form an opening in the radiator cap protrusion 80. A plastic molded radiator fill elbow 83 is attached to the protrusion 80 by means of an epoxy or other suitable adhesive. A cap 85 threadably engages tangs on the radiator fill elbow 13 to cover the fill hole.

The preferred mode of practicing the present invention is directed to heat exchangers that are widely used in both mobile and industrial applications. In many applications only one hot fluid, for example, engine coolant such as anti-freeze and water, transfers its heat by means of cooling tubes to a second fluid such as air, as shown in FIG. 1. In other applications, one hot fluid typically is directed into the heat exchanger and the heat from one hot fluid is cooled by a second hot fluid, typically engine coolant. Then the second hot fluid is cooled by a third fluid such as air. The first hot fluid which is normally the hottest of all three fluids such as, for example, engine or transmission oil flows into the heat exchanger where the first hot fluid transfers its heat to a second hot fluid. The second hot fluid then is cooled by means of the cooling tubes by the third fluid, as shown in FIG. 7, which is defined herein as a serial cooling system.

In another alternative embodiment of the present invention, a parallel cooling system is defined herein as a heat exchanger that is also used in both mobile and industrial applications. For example, more than one hot fluid flows into a heat exchanger where the two hot fluids are cooled by a third fluid, as shown in FIGS. 12 through 15. For example, the first hot fluid flows into the heat exchanger and its heat is transferred by means of cooling tubes to the third fluid. A parallel cooling circuit is provided and the second hot fluid flows into a separate cooling circuit wherein the second hot fluid flows through the tubular flow member 87 which transfers its heat to the third fluid.

Figure 12:
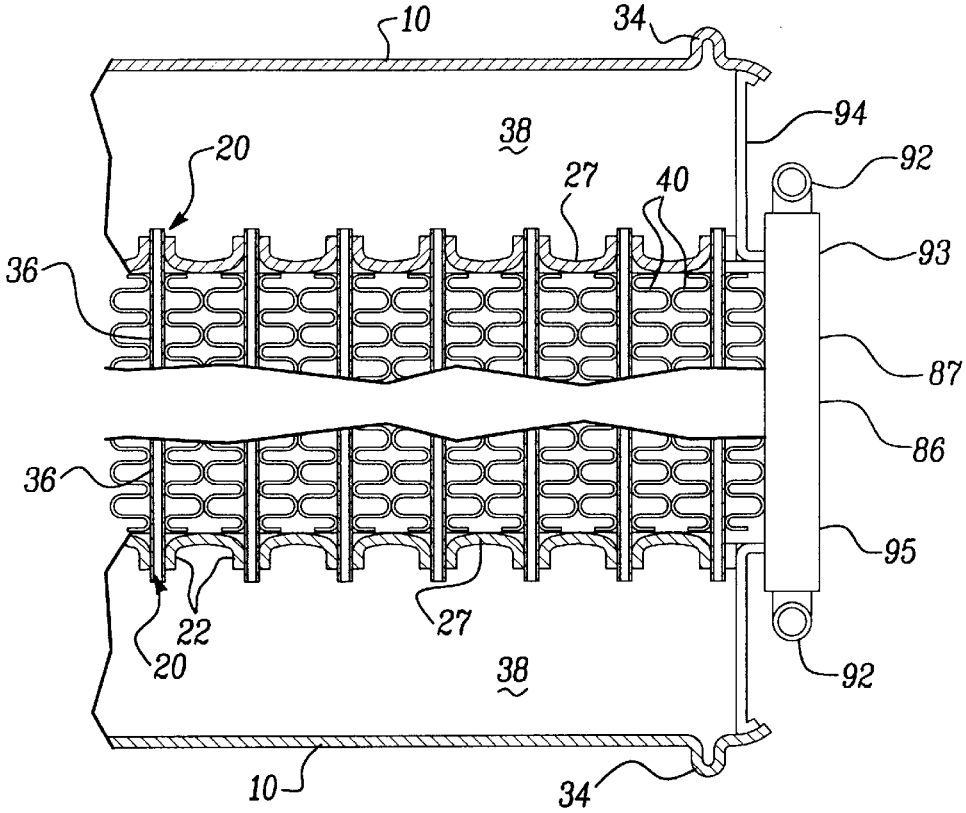
FIG. 12 is a sectional view of a heat exchanger having an auxiliary cooler connecting the top tank to the lower tank.
Figure 13:
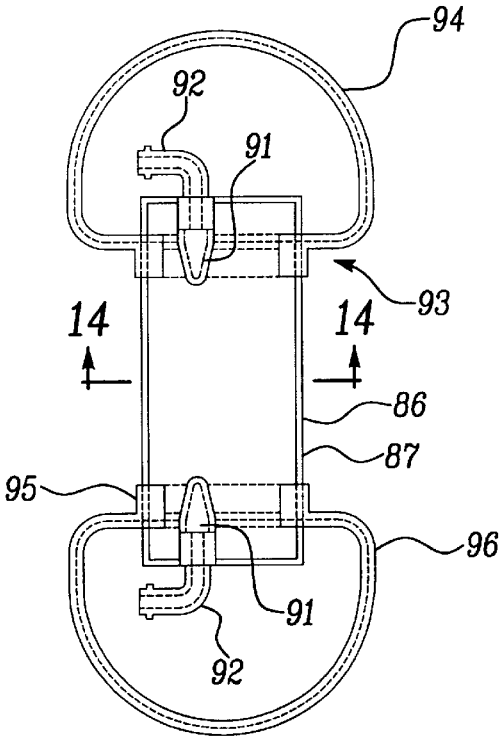
FIG. 13 is a side view of FIG. 12.
Figure 14:
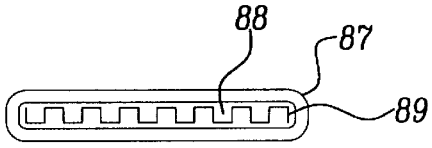
FIG. 14 is an enlarged cross-sectional view of the tubular support with a turbulator.
Figure 15:
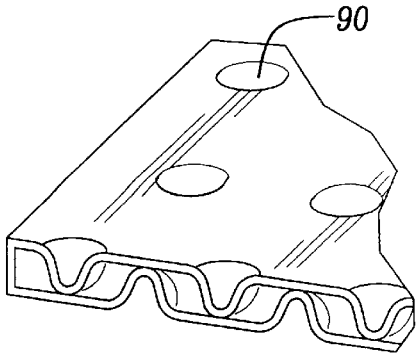
FIG. 15 is an enlarged cross-sectional view of the tubular support with dimples.

Thus, a secondary auxiliary fluid cooler 86, typically engine oil or transmission oil and a third fluid such as air is located adjacent to the automotive radiator, as shown in FIGS. 12 and 13. The auxiliary cooler 86 has a hollow tubular member 87 which replaces the side supports 60, 62. The hollow tubular member 87 has a passage 88 formed therein. The turbulator member 89 is inserted into the passage to cause the fluid therein to be moved by fins in the flow passage to cause the fluid to be turbulated to enhance heat transfer from the tubular member to the air as is well known in the prior art. Optionally, the turbulator can be brazed to the inner walls of the tubular member. To prevent flow bypass and to stiffen the walls of the tubular member 87. Alternatively, the hollow tubular member 87 may be formed with a number of dimples 90 which protrude into the passage 88 in an alternating pattern so as to turbulate the fluid therein as is known in the art. The ends of the hollow tubular member are closed by end forming and then flattened to seal the ends of the tubular member 17 closed. The end forming creates an opening into which a connector 92 can be inserted. The connector is brazed to the opening in the end formed end of the tubular member 87. The hollow tubular member is relatively flat and located adjacent to one of the plurality of cooling tubes 36. The width of the tubular member can vary depending on the application requirements. However, preferably the tubular member is same width as the cooling tubes 36. The hollow tubular member 87 is fastened to the tanks 10 by means of a pair of retaining tabs 93 that are formed in the oil cooler end caps 94. The tabs 93 capture the hollow tubular member 87 between the oil cooler end caps 94 for a purpose to be described later on. On the bottom of the hollow tubular member 87 is a second pair of retainer tabs 95, which are formed in the oil cooler end cap 96. The tabs 95 are formed so as to capture the bottom end of the hollow tubular member 87. The tabs 95 are fastened to a hollow tubular member 87 by means of a brazing. A series of discontinuous braze joints also connect the hollow tubular member 87 to the cooling fins 36. The top retaining tabs 93 permit the hollow tubular member 87 to slide past the tabs 93 to permit thermal growth of the hollow tubular member. Connection of the inlet/outlet of the hollow tubular member is formed by means of the connector 92. Thus, either engine oil or transmission oil may be made to flow through the hollow tubular member and transfer heat from the oil to the ambient surrounding air. It has been found that it may be advantageous to stack several hollow tubular members adjacent to each other in order to cool the hot engine oil or transmission fluid faster or to a lower fluid temperature as is well known in the art.

The hollow tubular member 87 may also be used as a side support for the heat exchanger tanks only. In this condition, the hollow tubular member 87 is flattened at each end and the end forming process would be eliminated.

Those skilled in the art will recognize that the heat exchanger described herein can be used for multiple applications where it is desired to cool hot fluids by means of a cooler fluid. Thus, the present invention can be used in applications such as charged cooled air-to-air coolers, industrial heat exchangers or radiators, to name just a few applications. The heat exchanger can also be used in refrigeration units, as a chiller. Alternatively, the heat exchanger may be used to cool air or other fluids.

It is to be understood that the invention is not limited to the exact construction illustrated and described above, but that various changes and modifications may be made without departing from the spirit and scope of the invention as defined in the following claims.

What is claimed is:

1. A heat exchanger for transferring thermal energy from at least two fluids to a third fluid, said heat exchanger comprising:

first and second elongated hollow metal bodies each made of a single piece, said hollow bodies forming first and second tanks by pressure which is above 50 MPA and having a fluid outlet, the one of at least two fluids flowing through said first and second tanks;

a side portion of each tank having a plurality of tube receiving apparatus;

a plurality of cooling tubes between the first and second tanks, each of said cooling tubes having a first end inserted into one of said plurality of tube receiving apertures of the first tank and a second end inserted into one of said plurality of tube receiving apertures of the second tank, said plurality of cooling tubes being sealingly joined to each tank in a leak proof manner to permit the one of at least two fluids to flow from the first tank to the second tank; and at least one hollow tubular member adjacent to the fin of one of said plurality of cooling tubes, said hollow tubular member adjacent to the first and second tanks, said hollow tubular member having a passage for flowing the other of the at least two fluids therethrough;

whereby the thermal energy of the at least two fluids is transferred to the third fluid.

2. A heat exchanger as claimed in claim 1 wherein the first and see second tanks formed by hydroforming.

3. A heat exchanger as claimed in claim 1 wherein said passage having a turbulator inserted therein.

4. A heat exchanger as claimed in claim 1 wherein the outer periphery of said passage is dimpled.

5. A heat exchanger as claimed in claim 1 wherein said cooling tubes are flat tubes and the tube receiving apertures in the tanks are slotted apertures oriented in the tanks to extend in a circumferential direction of the tanks.

6. A heat exchanger as claimed in claim 1 wherein at least one end of the first and second tanks are open, the open end being closed by a separate cap sealingly joined to the hollow bodies, said separate cap having a retaining tab, said retaining tab capturing said hollow tubular member.

7. A heat exchanger as claimed in claim 1 wherein the first tank having an overflow protrusion.

8. A heat exchanger as claimed in claim 1 wherein the first tank having an opening and further comprising:

a radiator cap neck.

9. A heat exchanger as claimed in claim 1 further comprising an elastomeric seal interposed the first end of each of said cooling tubes and one of said plurality of tube receiving apertures.

10. A heat exchanger as claimed in claim 1 wherein said at least one hollow tubular member having a pair of ends, said pair of ends are end formed and further comprising:

an inlet fluid port; and an outlet fluid port.

11. A heat exchanger as claimed in claim 1 wherein said at least one hollow tubular member is joined to at least one of said plurality of cooling tubes.

12. A heat exchanger as claimed in claim 11 wherein said at least one hollow tubular member is joined to at least one of said plurality of cooling tubes in at least two spaced apart braze joints.

13. A heat exchanger for transferring thermal energy from at least two fluids to a third fluid, said heat exchanger comprising:

first and second elongated hollow metal bodies made of a single piece, said hollow bodies forming first and second tanks by pressure which is above 50 MPA and having a fluid outlet, the one of at least two fluids flowing through said first and second tanks;

a side portion of each tank having a plurality of tube receiving apparatus;

a plurality of cooling tubes between the first and second tanks, each of said cooling tubes having a first end inserted Into one of said plurality of tube receiving apertures of the first tank and a second end inserted into one of said plurality of tube receiving apertures of the second tank, said plurality of cooling tubes being sealingly joined to each tank in a leak proof manner to permit the one of at least two fluids to flow from the first tank to the second tank;

at least one hollow tubular member adjacent to the fin of one of said plurality of cooling tubes, said hollow tubular member adjacent to the first and second tanks, said hollow tubular member having a passage for flowing the other of the at least two fluids therethrough;

whereby the thermal energy of the at least two fluids is transferred to the third fluid; and at least one hollow tubular member connecting the first and second tanks and adjacent to one of said plurality of cooling tubes.

14. A heat exchanger as claimed in claim 13 wherein the first tank having an over flow protrusion.

15. A heat exchanger as claimed in claim 13 wherein said hollow tubular member is connected to at least one of a plurality of cooling tubes.

16. A heat exchanger as claimed in claim 13 wherein each end of said at least one hollow tube is flattened.

17. A heat exchanger as claimed in claim 13 wherein said end cap having a retaining tab, said retaining tab capturing said at least one hollow tubular member.

18. A heat exchanger as claimed in claim 13 further comprising:

an elastomeric seal interposed the first end of each of said cooling tubes and one of said plurality of tube receiving apertures; and at least one hollow tubular member connecting said first tank to said second tank to provide structural support.

19. A heat exchanger as claimed in claim 18 wherein said first and second tanks are formed by hydroforming.

20. A heat exchanger as claimed in claim 19 further comprising:

an elastomeric seal interposed at least one of said plurality of cooling tubes and said tube receiving aperture in the tank.

21. A heat exchanger as claimed in claim 18 wherein said hollow tubular member having a passage, said passage formed with a flow turbulator.

* * * * *